US008651883B2

(12) United States Patent
Becavin et al.

(10) Patent No.: US 8,651,883 B2
(45) Date of Patent: Feb. 18, 2014

(54) MULTICONTACT CONNECTOR FOR MOUNTING ON A PANEL

(75) Inventors: Patrice Becavin, Auzouer en Touraine (FR); Emmanuel Demaret, Rochecorbon (FR); Sylvain Mougin, Le Boulay (FR)

(73) Assignee: Radiall, Rosny sous Bois (FR)

( * ) Notice: Subject to any disclaimer, the term of this patent is extended or adjusted under 35 U.S.C. 154(b) by 45 days.

(21) Appl. No.: 13/402,424

(22) Filed: Feb. 22, 2012

(65) Prior Publication Data

US 2012/0244737 A1 Sep. 27, 2012

(30) Foreign Application Priority Data

Mar. 23, 2011 (FR) ..... 11 52389

(51) Int. Cl.
*H01R 13/62* (2006.01)

(52) U.S. Cl.
USPC ..... 439/157

(58) Field of Classification Search
USPC ..... 439/157, 325, 310, 347
See application file for complete search history.

(56) References Cited

U.S. PATENT DOCUMENTS

| | | | | |
|---|---|---|---|---|
| 4,586,771 | A * | 5/1986 | Kraemer et al. | 439/325 |
| 5,169,327 | A * | 12/1992 | Hatagishi | 439/157 |
| 5,478,251 | A * | 12/1995 | Jaklin | 439/157 |
| 5,618,194 | A * | 4/1997 | Maue et al. | 439/157 |
| 6,254,407 | B1 * | 7/2001 | Burns | 439/157 |
| 6,692,274 | B2 * | 2/2004 | Maegawa | 439/157 |
| 7,329,138 | B2 * | 2/2008 | Van Der Mee et al. | 439/347 |
| 2006/0223371 | A1 | 10/2006 | Van Der Mee et al. | |
| 2006/0223373 | A1 | 10/2006 | Van Der Mee et al. | |

FOREIGN PATENT DOCUMENTS

| | | | |
|---|---|---|---|
| EP | 0 631 347 | A2 | 12/1994 |
| EP | 1 708 313 | A2 | 10/2006 |
| EP | 1 708 315 | A2 | 10/2006 |
| WO | WO 2008/050183 | A1 | 5/2008 |

OTHER PUBLICATIONS

Nov. 7, 2011 French Search Report issued in Application No. FR 1152389 (with translation).

* cited by examiner

*Primary Examiner* — Alexander Gilman
(74) *Attorney, Agent, or Firm* — Oliff PLC

(57) ABSTRACT

A multicontact connector having a housing including cavities; contacts each having a portion received in one of the sockets and another portion projecting beyond a face of the housing; and a locking cap for locking the connector to a complementary connector, the cap being mounted on the housing and configured to slide relative to the housing between a locked position and unlocked position; and the cap projects beyond the face of the housing over a distance greater than the distance whereby the contacts project from the face of the housing.

11 Claims, 7 Drawing Sheets

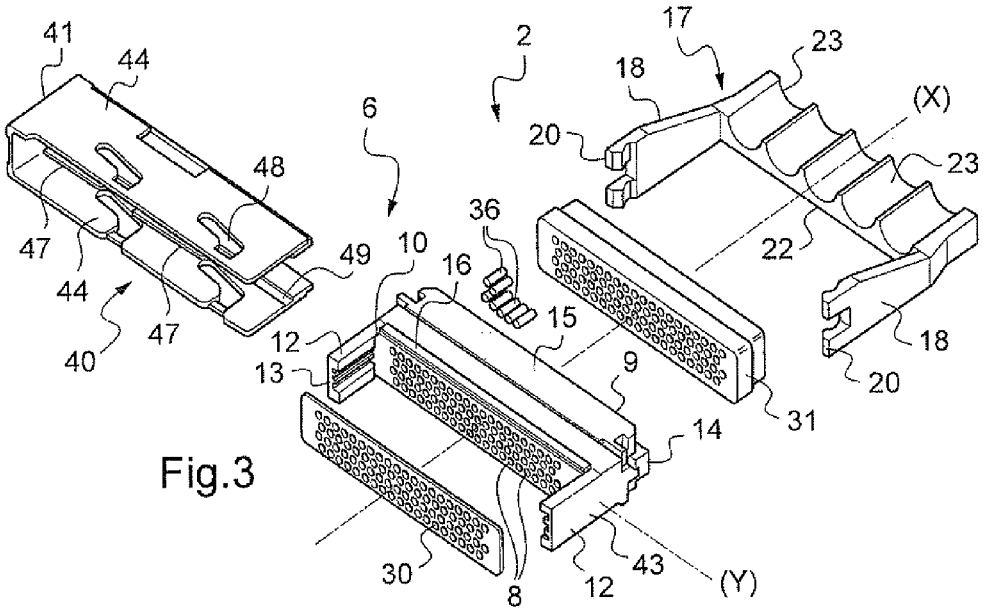
Fig.3
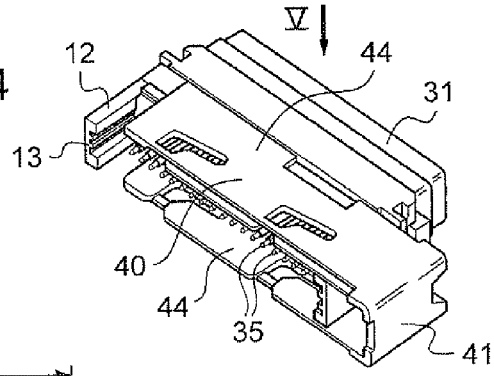
Fig.4
Fig.5
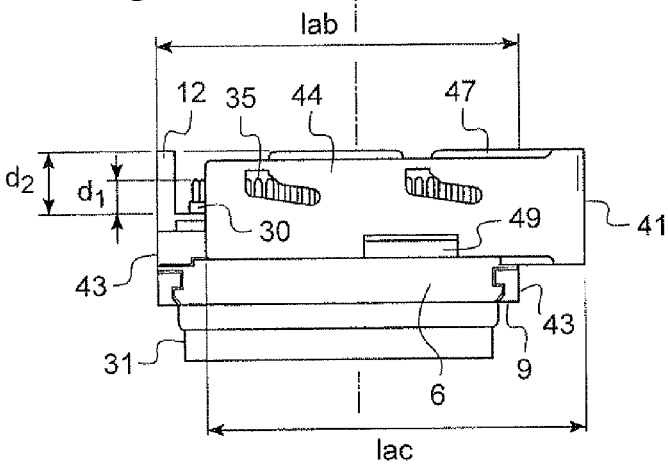

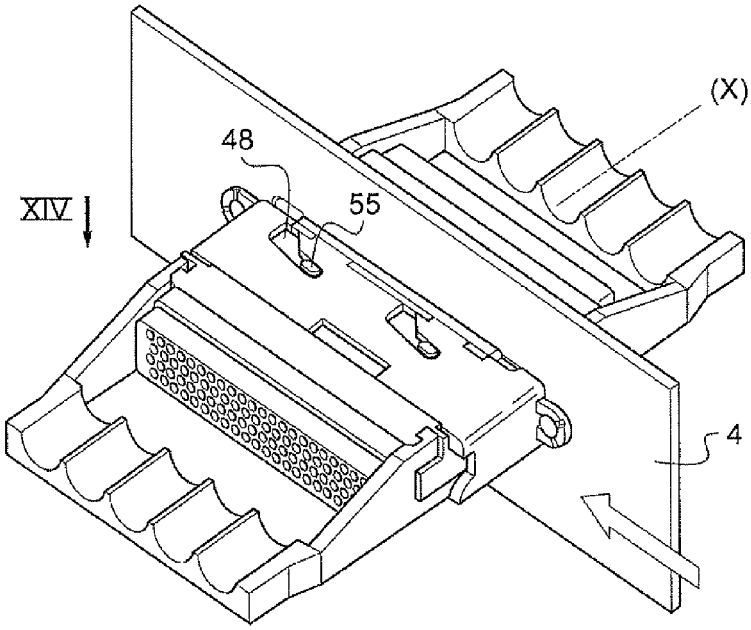
Fig.13
Fig.16
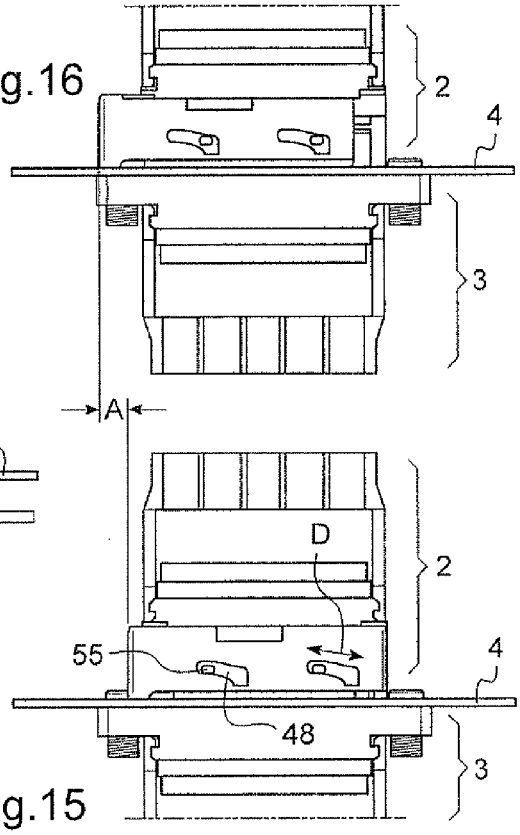
Fig.14
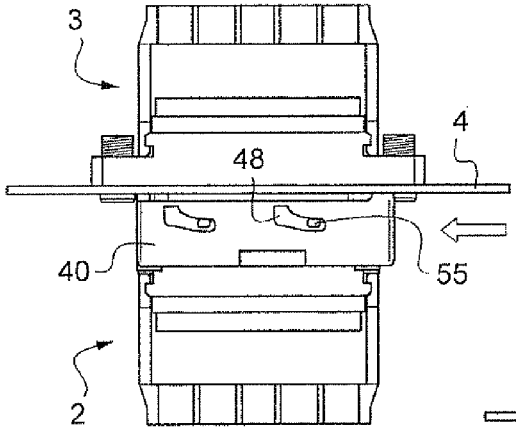
Fig.15

MULTICONTACT CONNECTOR FOR MOUNTING ON A PANEL

FIELD OF THE INVENTION

The present invention relates to a multicontact connector and to a connection assembly comprising multicontact connectors that are locked together.

BACKGROUND OF THE INVENTION

Application EP 1 708 313 in the name of the Applicant discloses a connection assembly comprising a first multicontact connector and a second multicontact connector of complementary type. Each connector comprises a housing receiving contacts, and the connection assembly includes a cap enabling the first and second connectors to be locked together. That application EP 1 708 313 does not address the problem of protecting the contacts of each connector before the connectors are locked together.

There exists a need to benefit from a multicontact connector that can be locked in simple and effective manner with a multicontact connector of complementary type, while reducing the risk of the contacts being damaged prior to locking with the connector of complementary type.

OBJECT AND SUMMARY OF THE INVENTION

An object of the invention is to satisfy this need and, in exemplary embodiments, it achieves this object by means of a multicontact connector comprising:

- a housing including sockets;
- contacts each having a portion received in one of the sockets and another portion projecting beyond a face of the housing; and
- a locking cap for locking the connector to a connector of complementary type, said cap being mounted on the housing and being configured to slide relative to the housing between a locked position and unlocked position;

wherein the cap projects beyond said face of the housing over a distance greater than the distance whereby the contacts project from said face of the housing.

The distance along which the cap projects beyond said face of the housing is measured for example between said face of the housing and the end of the cap that is closest to the multicontact connector of complementary type when the two connectors are locked together.

Because the cap projects beyond the contacts relative to a given face of the housing, the contacts can be protected by the cap while the multicontact connector is not locked to a multicontact connector of complementary type. This reduces accidental access by an operator to the contacts of the connector while it is not locked to a connector of complementary type.

Once in place in the housing, the contacts may project beyond said face of the housing by the same distance or by distances that are different. Under such circumstances, some of the contacts project for example by a first distance and other contacts project by a second distance, and the cap projects beyond said face of the housing by a distance that is greater than the greater of the first and second distances.

Said face of the housing comes to face the multicontact connector of complementary type when the connectors are locked together, and is referred to below as the "connection face".

The housing may be made as a single piece, thereby making it simpler to fabricate and reducing the number of steps required for assembling the connector. There is then no need to have recourse to an insert including the sockets and that needs to be inserted into the housing.

Between five and one hundred sockets may be arranged in the housing. These sockets may all be identical and they may present a cross-section that is circular in shape.

The housing need not have a rim between the portions of the contacts that are not received in the sockets and the cap. Such a rim, also referred to as the housing cavity, is present in particular on the housings of the connectors disclosed in application EP 1 708 313. Because of the presence of the rim, the portions of the contacts projecting beyond the housing are directly in register with the cap. Such a connector enables space to be saved since the thickness of the cap replaces the thickness of the rim, e.g. contrary to the connector of application EP 1 708 313 in which the thickness of the cap is in addition to the thickness of the rim.

At least one groove may be formed in the cap to co-operate with a locking peg of the connector of complementary type.

The groove may present a longer dimension measured between two opposite edges of said groove and defining the amplitude of the movement of the cap between the locked position and the unlocked position. With such a connector, passing from the locked position to the unlocked position does not cause the cap to travel over the entire width of the housing, so the cap and the housing overlap over a fraction of their width when the cap is in the unlocked position. Below, the term "width" is used to designate the greatest dimension measured perpendicularly to the axis of the sockets in the housing.

The cap may present a width that is greater than the width of the housing. When the cap is mounted on the housing, an empty space may be arranged inside the cap and a tool may be inserted into the empty space in order to force the cap to pass from the locked position to the unlocked position.

The ratio between the width of the cap and the width of the housing may be such that, when the cap is in the unlocked position on the housing, all of the contacts in place in the housing are covered by the cap when the connector is observed perpendicularly to the axis of the sockets. This enables all of the contacts of the connector to be protected by the cap when the first connector is not locked to the connector of complementary type.

In a variant, the ratio between the width of the cap and the width of the housing is such that when the cap is in the unlocked position on the housing, only some of the contacts in place in the housing are covered by the cap when the connector is observed perpendicularly to the axis of the sockets, while other contacts in place in the housing are uncovered. Only some of the contacts are thus protected by the cap prior to the connectors being locked together.

The cap may be substantially U-shaped in section in a plane perpendicular to the axis of the sockets. In such an example, the cap has two strips that may be substantially parallel and connected together by a back. The strips and the housing may include means that co-operate so that the two strips remain parallel while the cap is being moved relative to the housing so as to pass from the locked position to the unlocked position, or vice versa.

The connector may include an attachment portion extending the housing from a face of the housing opposite from the connection face. By way of example, the attachment portion may be configured to receive cables having the contacts of the connector mounted thereon. In a plane perpendicular to the axis of the sockets, the attachment portion may include an attachment zone having a surface for receiving cables, which surface is semicircular. A plurality of attachment zones may be arranged side by side across the width of the housing.

The cap may carry at least one visible indicator arranged in such a manner as to be visible by an operator while the cap is in the unlocked position and in such a manner as to be masked by the housing when the cap is in the locked position.

When a contact is received in the housing, the portion of the contact that is received in the socket may be of a length that lies in the range 50% to 75% of the length of the contact.

Other exemplary embodiments of the invention also provide a multicontact connector configured to be connected to the multicontact connector, and comprising a second housing having sockets receiving contacts and at least one locking peg configured to co-operate with the cap, wherein the locking peg is made integrally with the second housing.

Making the locking peg integrally with the second housing in this way simplifies fabricating and assembling the multicontact connector.

Other exemplary embodiments of the invention also provide a connection assembly comprising multicontact connectors of complementary types, as described above, said connectors being locked together by means of the cap.

The connection assembly may be configured to be mounted on a panel. By way of example, one of the multicontact connectors includes means for assembly on the panel, e.g. screws. By way of example, the connector has two assembly means arranged perpendicularly to the axis of the sockets at opposite ends of the housing, with the distance between these assembly means possibly defining the maximum overall width of the connection assembly.

The multicontact connectors for locking together may include means for guiding one relative to the other. By way of example, these means may be portions in relief of complementary type that cooperate to provide a keying function. These portions in relief may also define attachment means for attaching one of the connectors to the other.

The contacts of the connectors may be of the same type or of different types. The contacts may comprise contacts conveying an optical signal, and/or contacts conveying an electrical signal, and/or contacts conveying power.

With connection assemblies forming exemplary embodiments of the invention, it is possible to ensure that the housing of a connector covers the housing of the other connector with which it is locked only via the guide and/or attachment means for guiding and/or attaching one housing to the other.

By way of example, one of the multicontact connectors may form a plug while the other multicontact connector forms a receptacle.

BRIEF DESCRIPTION OF THE DRAWINGS

The invention can be better understood on reading the following description of non-limiting embodiments thereof and on examining the accompanying drawings, in which:

FIG. 3 is an exploded view along arrow 11 of the first connector shown in FIG. 2;

FIG. 4 is a view of certain elements of the first connector shown in FIG. 2;

FIG. 5 is a view along arrow V of the first connector shown in FIG. 4;

FIGS. 11 to 14 show different steps when locking together the connectors of the connection assembly, FIGS. 12 and 14 being views looking respectively along XII and XIV of the assembly as shown in FIGS. 11 and 13.

FIGS. 15 and 16 are plan views of the FIG. 1 connection assembly, respectively when the connectors are locked together and when the connectors are unlocked;

MORE DETAILED DESCRIPTION

Figure 1:
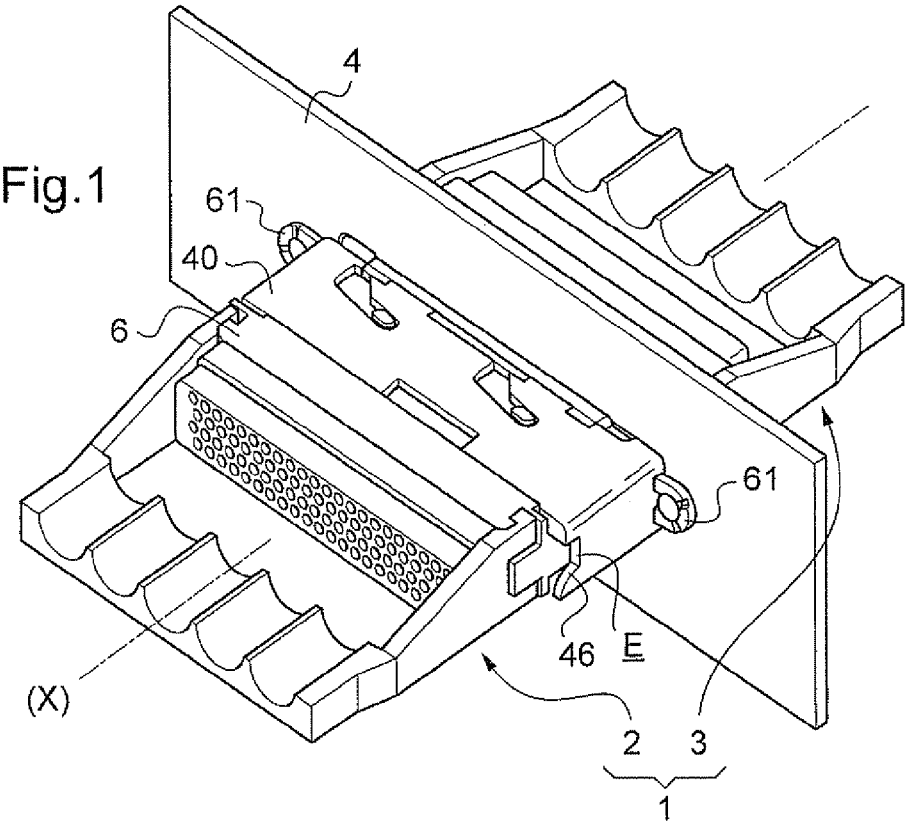
FIG. 1 is a perspective view of a connection assembly constituting a first embodiment of the invention, this assembly comprising a first multicontact connector and a second multicontact connector.

FIG. 1 shows a connection assembly given overall reference 1 constituting a first embodiment of the invention. This connection assembly 1 comprises a first multicontact connector given overall reference 2 and a second multicontact connector given overall reference 3. The multicontact connectors 2 and 3 are of complementary type, the first connector 2 being of the male type, for example, being in particular a plug, while the second connector 3 is of the female type, being in particular a receptacle.

In the embodiments described below, the connection assembly 1 is configured to be mounted on a panel 4, e.g. a panel 4 forming part of an electronic equipment housing, e.g. equipment on board an aircraft or in a circuit-breaker panel.

The connectors 2 and 3 convey signals that are optical signals, electrical signals, or power.

Figure 2:
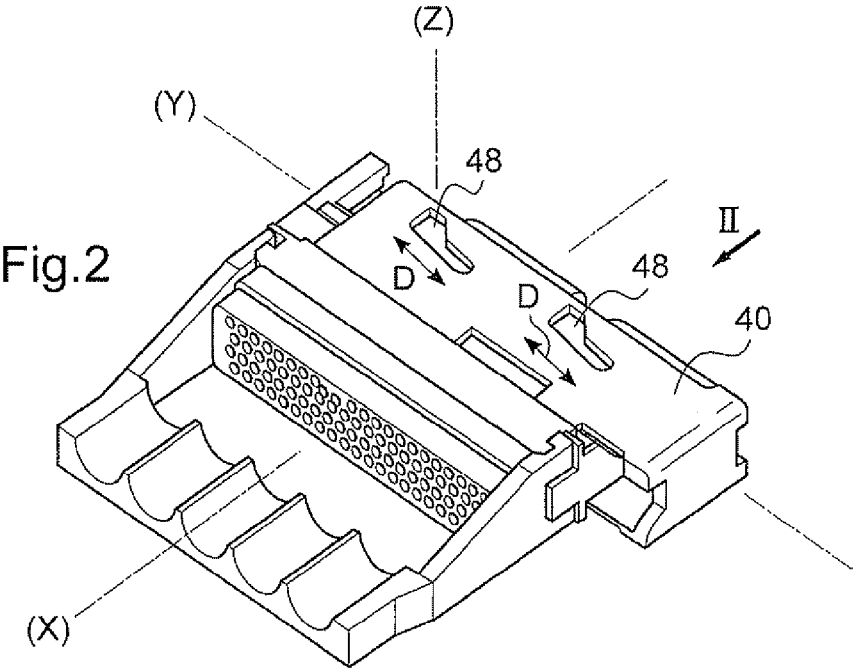
FIG. 2 is a view of the first connector of FIG. 1, shown in isolation.

FIGS. 2 and 3 show the first multicontact connector 2 in isolation.

The connector 2 comprises a housing 6 that is made as a single piece of plastics material in the example described.

A plurality of cavities 8 are formed in the housing 6, each extending from a rear face 9 to a face 10 that faces the second connector 3 when the connectors 2 and 3 are locked together. The face 10 is also referred to as the "connection face".

In the embodiment described, the faces 9 and 10 are parallel and they extend perpendicular to the rectilinear axis X of the cavities 8, this rectilinear axis being referred to below as the "axis of the first connector".

The housing 6 may have two arms 12 projecting beyond the connection face 10 on either side thereof, these arms 12 possibly including portions in relief 13 for performing a role that is described below. When the housing presents a rectangular shape in section perpendicularly to the axis X, the arms 12 may extend parallel to the short sides only of the housing 6. The housing 6 may be made as a single portion or as two portions for making it easier to install holder parts 36, as described below.

A slot 14 extends perpendicularly to the axis X over all or part of the top face 15 of the housing, this slot being provided in particular at the bottom of a shoulder. A rib 16 may be formed on the top face 15 of the housing so as to extend parallel to the slot 14. In the embodiment described, the rib is arranged on the top face 15 between the slot 14 and the edge constituting the boundary between the top face 15 and the connection face 10.

As can be seen in FIGS. 2 and 3, the first connector 2 may include an attachment portion 17 extending the housing 6 along the axis X from the rear face 9. By way of example, the attachment portion 17 comprises two arms 18, each having one end 20 that is releasably attached to the housing 6 and another end that is connected to a junction portion 22. The junction portion 22 defines a plurality of attachment zones 23. In the embodiment described, five attachment zones are associated with the housing 6, however the invention is not limited to any particular number of attachment zones 23 nor is it limited to any particular arrangement of these zones 23 relative to one another.

Each attachment zone 23 may present a semicircular reception surface on which the cables to which the first connector 2 is connected may rest and/or be fastened. The first connector 2 may include a front gasket 30 for placing on the connection face 10 of the housing 6, and the front gasket 30 may include passages that come into register with the sockets 8 when the gasket 30 is in place on the connection face 10. By way of example, the front gasket 30 may be made of silicone.

The first connector 2 may include a rear gasket 31 for placing against the rear face 9 of the housing. Similarly to the front gasket 30, the rear gasket 31 may include as many passages as the housing 6 includes cavities 8, the passages in the rear gasket 31 coming into register with the cavities 8 when the rear gasket 31 is in place on the rear face 9 of the housing.

When the first connector 2 of the embodiment under consideration is observed looking along the axis X, it presents the following elements in succession: the front gasket 30; the housing 6; the rear gasket 31; and the attachment portion 17.

The cavities 8 receive some of the contacts 35 of the first connector 2. When they are in place in the housing 6, the contacts 35 also extend out from the cavities 8, i.e. being cantilevered out into the passages of the front gasket 30. The contacts 35 thus have a portion received in a corresponding cavity 8 and a portion that projects through a distance $d_1$ beyond the connection face 10 of the housing. The portion received in a socket 8 may present a length lying in the range 50% to 75% of the length of the contacts 35.

The contact 35 may be of the same type, e.g. conveying an optical signal, an electrical signal, or power. In a variant, different types of signals and power may be conveyed by the connection assembly 1, with contacts of different sizes and types being arranged simultaneously in the housing 6.

The contacts 35 may be single or multiple contacts, such as coaxial or triaxial or quadrax contacts, RJ45 contacts, or any type of broadband contact. The contacts 35 may also be optical contacts with so-called "expanded beam" type lens contacts or so-called "physical contact" contacts of the ARINC 801 or EN 4531 type, or indeed they may be optoelectronic contacts.

Where appropriate, the distance $d_1$ may be the same for all of the contacts 35 installed in the housing 6. In a variant, the contacts 35 project through different distances beyond the connection face 10 and the distance $d_1$ corresponds to the greatest distance over the first connector as a whole by which a contact 35 projects beyond the connection face 10.

A holder part 36, commonly referred to as a "clip", may be arranged in each cavity 8 close to the rear face 9, this holder part 36 serving to fasten a contact 35 in the housing 6. In a variant, the clips 36 may be molded integrally with the housing 6, in particular when the housing 6 is made up of two portions.

As shown in the figures, the first connector 2 includes a locking cap 40. Such a cap may be U-shaped in section in a plane perpendicular to the axis X of the connector 2. The cap 40 then has a back 41 that faces one of the side faces 43 of the housing 6 and two parallel strips 44 that overlie respectively a portion of the top face 15 of the housing and a portion of the bottom face of the housing 6.

On each of its side edges, a strip 44 may include a spline 47 extending continuously or otherwise along an axis Y that is perpendicular to the axis X. One of the splines 47 is configured to co-operate with the slot 14 formed in the top face 15 of the housing 6 of the first connector 2, while the role of the other spline 47 facing the second connector 3 is described below.

One of the strips 44 may include a groove 49 for a role that is described below.

As shown in FIGS. 2 and 3, one or more slots 48 may be formed in one or both of the strips 44. These slots 48, when observed in a direction Z that is perpendicular to the axes X and Y, may be substantially L-shaped. As explained below, the long dimension D measured between two opposite edges of the slot 48 defines the amplitude of the sliding movement of the locking cap 40 relative to the housing 6 on passing from a locked position to an unlocked position.

The co-operation between the spline 47 and the slot 14 in the housing 6 enables the locking cap 40 to slide cleanly relative to the housing 6, this sliding serving to cause the cap 40 to go from a locked position to an unlocked position, or vice versa. This co-operation serves to keep the two strips 44 parallel during locking and unlocking stages. In co-operation with the rib 16, the groove 49 serves to guide the movement of the cap 40 in translation on the housing 6.

As can be seen in FIGS. 4 and 5, when the cap 40 is mounted on the housing 6, it projects beyond the connection face 10 by a distance $d_2$ that is greater than the distance $d_1$. By way of example, the difference between $d_2$ and $d_1$ is several millimeters (mm), e.g. 3 mm. When the cap 40 has the above-mentioned spline 47, the distance $d_2$ by which the cap projects beyond the connection face 10 of the housing 6 is measured between the connection face 10 of the housing and the end of the spline 47 facing the second connector 3 when the connectors 2 and 3 are locked together, as shown in FIG. 5.

Figure 6:
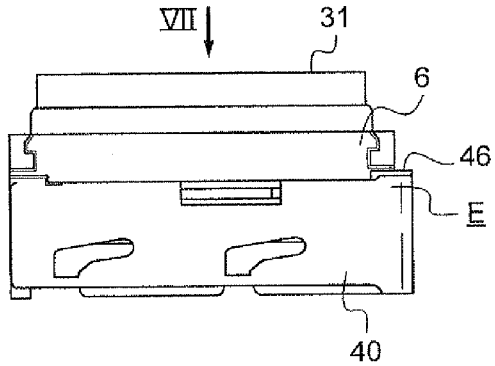
FIG. 6 is a view similar to the FIG. 5 view of the first connector, with the contacts not being shown.
Figure 7:
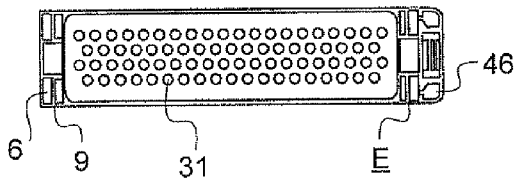
FIG. 7 is a view looking along VII of the first connector shown in FIG. 6.

The cap 40 is configured to cover the portions of the contacts 35 that are not arranged in the cavity 8. When the connector 2 has a downstream gasket 30 as described above, the portions of the contacts 35 that are covered by the cap 40 are not the same as the portions arranged in the sockets 8 of the housing, and are not the same as the portions arranged in the passages in the front gasket 30. As shown in FIGS. 4 and 5, the cap may come directly into register with the contacts 35 level with the portions it covers of the contacts 35. Contrary to that which is disclosed in application EP 1 708 313, in the embodiment described, the housing 6 does not have an annular or other rim between the locking cap 40 and said portions of the contacts 35 that are not received in the cavities, and where appropriate that are not received in the passages of the front gasket 30. The portions of the contacts 35 that are not received in the cavities and that are not received in the front gasket 30 may be visible through the slots 48 of the cap 40. As can be seen in FIGS. 6 and 7, the cap may present a width lac measured along the axis Y from the back 41 to the free ends of the strips 44 that is greater than the width lab of the housing 6 as measured along the axis Y between two opposite side faces 43.

A portion 46 of the locking cap 40 may thus be free of any engagement with the housing 6 because of this difference in width, which portion 49 thus defines an empty space E, as can be seen for example in FIG. 6.

In the example of FIG. 5, the locking cap 40 in the locked position covers only some of the contacts 35, the other contacts 35 being uncovered. In variants that are not shown, the ratio of the width lac of the locking cap 40 to the width lab of the housing 6 is such that when the locking cap 40 is in the unlocked position, and when the first connector 2 is observed perpendicularly to the axis X, it covers all of the contacts 35 that are installed in the housing 6.

Figure 8:
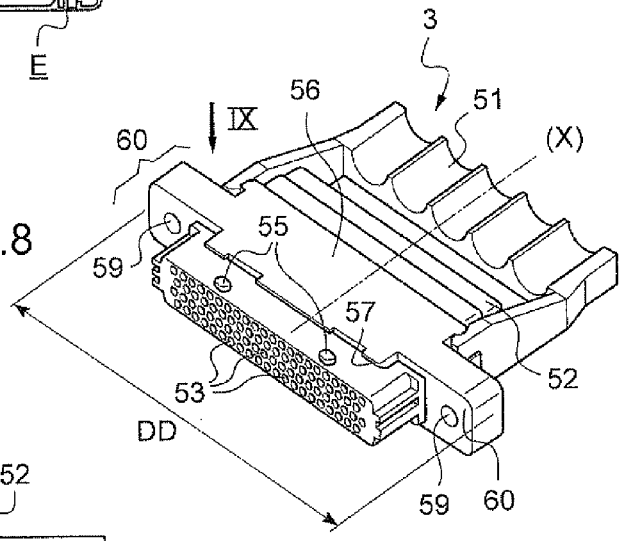
FIG. 8 is a perspective view of the second connector of the assembly shown in FIG. 1, shown in isolation.
Figure 9:
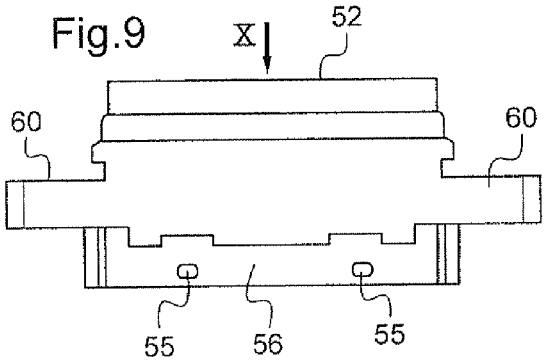
FIG. 9 is a view looking along IX of the second connector shown in FIG. 8.
Figure 10:
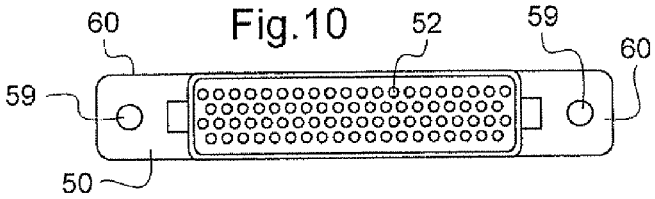
FIG. 10 is a view looking along X of the second connector shown in FIG. 9.
Figure 11:
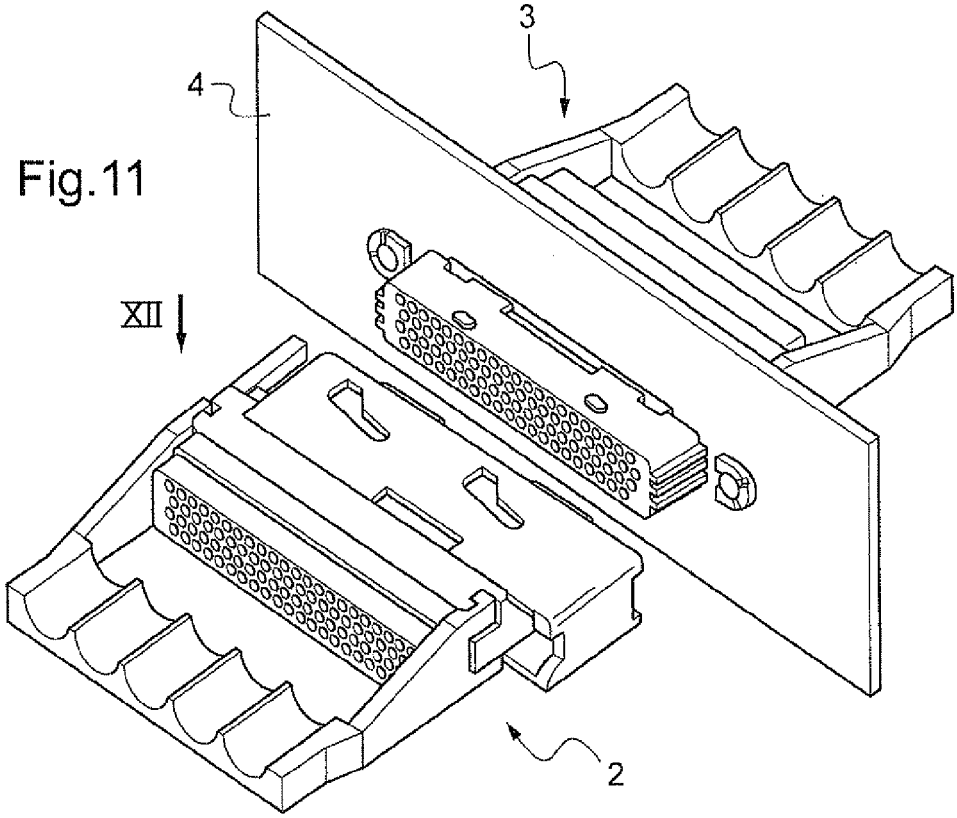
Figure 12:
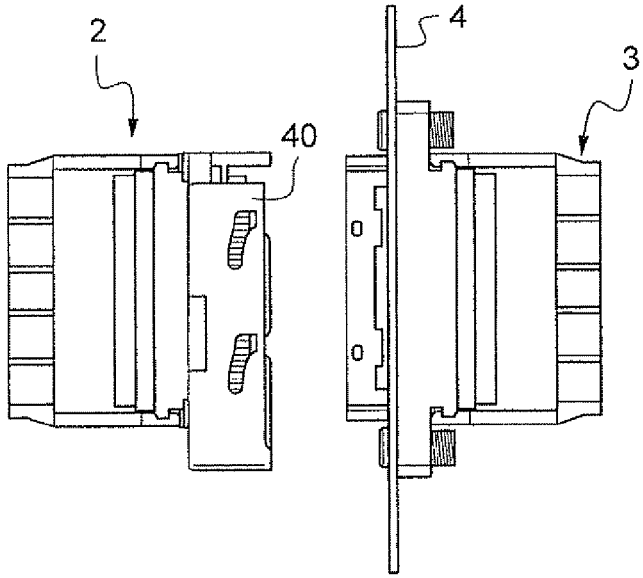

FIGS. 8 to 10 show in isolation the second connector 3 of the connection assembly 1. Similarly to the above-described first connector 2, the second connector 3 may comprise a housing 50 made as a single piece, an attachment portion 51 for attaching cables, and a rear gasket 52. Cavities 53 are formed in the housing 50, these sockets receiving contacts of type complementary to the contacts 35, i.e. the contacts in facing cavities 53 and 8 are of complementary types.

As shown in FIG. 8, one or more locking pegs 55 may be formed at least on the top face 56 of the housing 50. Other locking pegs may also be arranged on the bottom face of the housing 50.

In the embodiments described, the locking pegs 55 are made integrally with the housing 50.

In addition, and similarly to the above description with reference to the top face 14 of the housing 6, a slot 57 may be formed along the top face 56 of the housing 50, said slot 57 extending parallel to an axis perpendicular to the axis of the sockets 53. The axis of the cavities 53 in the embodiment described is parallel to the axis x when the connectors 2 and 3 of the connection assembly 1 are locked together, so this axis is referred to below as the "axis X". The slot 57 is configured to co-operate with the other spline 47 of the cap 40 to enable the locking cap 40 to slide cleanly relative to the housing 50 of the second connector 3. This co-operation serves to ensure that the two strips 44 are kept parallel during locking and unlocking stages.

Unlike the first connector 2, the second connector 3 may include fastener means 60 for fastening to the panel 4. By way of example, the second connector 3 includes two fastener means 60 located at the opposite side ends of the housing 50 and received in openings 59 formed in these side ends.

Each fastener means 60 comprises a screw 61, for example.

As can be seen in FIG. 8, the maximum overall width occupied by the connection assembly 1 in the embodiment described is determined by the distance DD between the two fastener means 60.

In an embodiment of the connection assembly 1 of the invention, the length measured along the axis X between the rear face 9 of the housing 6 and the free end of each of the arms 12 is 25 mm, and the length of the rear gasket 31 measured along the axis X is 9 mm. Still in this embodiment, the height of the housing 6 measured between its top face and its bottom face is 14 mm, the width lac of the cap is 62 mm, and the amplitude along which the cap 40 moves on passing from the unlocked position to the locked position, and vice versa, is 8 mm.

Concerning the second connector 3, the distance DD between the two fastener means 60, as measured perpendicularly to the axis X is 80 mm, the height of the housing 50 is 14 mm, and the length of the housing 50 measured along the axis X between two opposite faces is 23.50 mm.

The values given above for those distances are naturally given purely by way of indication, and in other exemplary embodiments, the values could be smaller than those given above.

With reference to FIGS. 11 to 14, there follows a description of the steps when locking the first connector 2 to the second connector 3.

During a first step, the first connector 2 with the locking cap 40 in the unlocked position is pushed, e.g. by hand, towards the second connector 3 which has previously been inserted through an opening in the panel 4 and secured to the panel 4. During this step, keying is performed by co-operation between portions in relief 13 formed in each of the arms 12 of the housing 6 and portions in relief of complementary type formed on the side faces of the housing 50. These may be splines co-operating with grooves, for example.

At the end of this step, the portions of the contacts 35 that are not received in the cavities 8, and where applicable that are not received in the passages of the front gasket 30, are received at least in part inside the sockets 53 of the housing 50, and the locking cap 40 is in contact with the housings 6 and 50. Still at the end of this step, the locking pegs 53 of the housing 50 are received in the small portion of the L-shape formed by each slot 48 in the locking cap 40.

During a subsequent step, a force is exerted, e.g. by hand, perpendicularly to the axis X. This force causes the locking cap 40 to slide relative to the housings 6 and 50. During this sliding, each spline 47 of the cap 40 is moved in translation along a slot of the housing 6 or of the housing 50.

Figure 19:
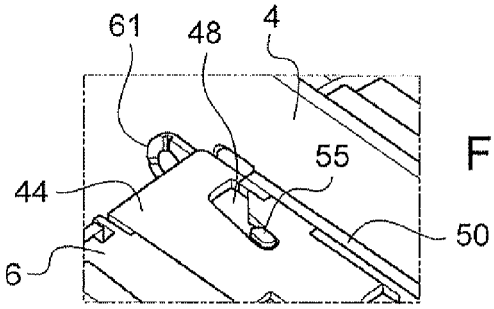
FIG. 19 is a detail of FIG. 1.

The sliding of the cap 40 causes each peg 55 to advance along the large portion of the L-shape of each slot 48. At the end of this step, as can be seen in FIG. 19, each peg 55 comes into abutment against an edge of the slot 48 and is blocked therein. The cap 40 is then in the locked position, securing the connectors 2 and 3 together.

FIGS. 15 and 16 show respectively a plan view of the connection assembly 1 when the connectors 2 and 3 are locked together and when the same connectors are not locked together. Comparing these two figures shows that the amplitude A of the sliding of the cap 40 on passing from the unlocked position to the locked position, or vice versa, corresponds to the distance D between the opposite edges of the large portion of each of the slots 48.

Figure 17:
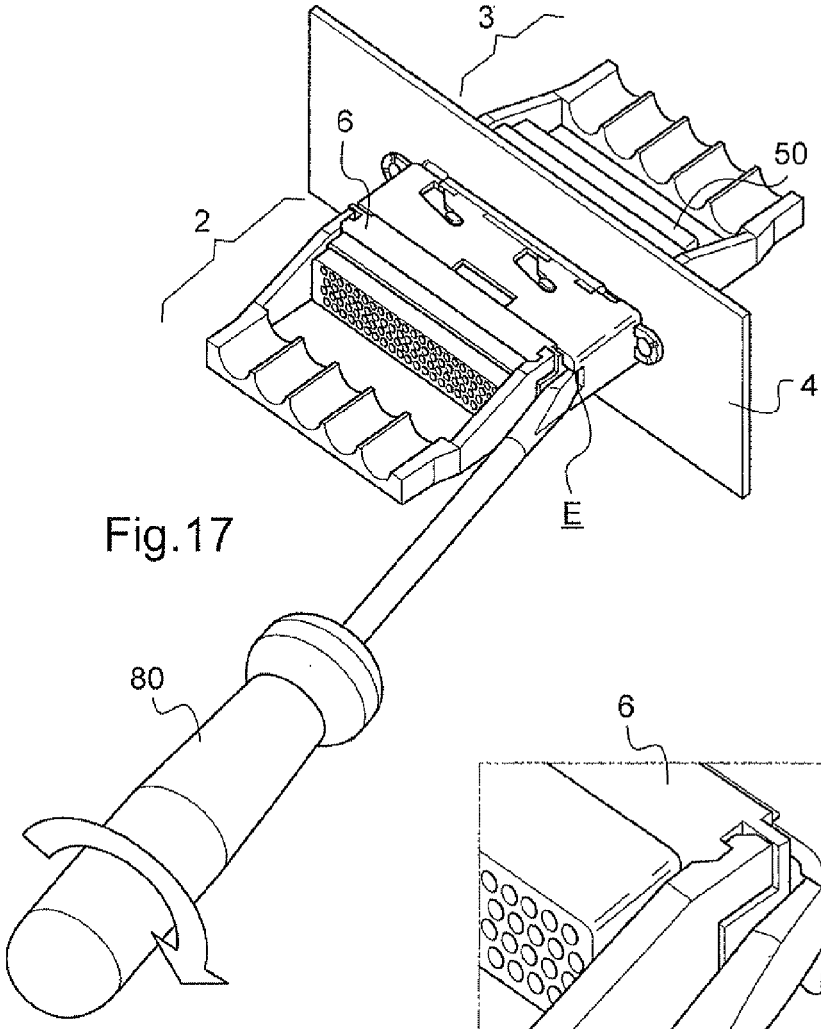
FIGS. 17 and 18 show a step during the unlocking of the connectors.
Figure 18:
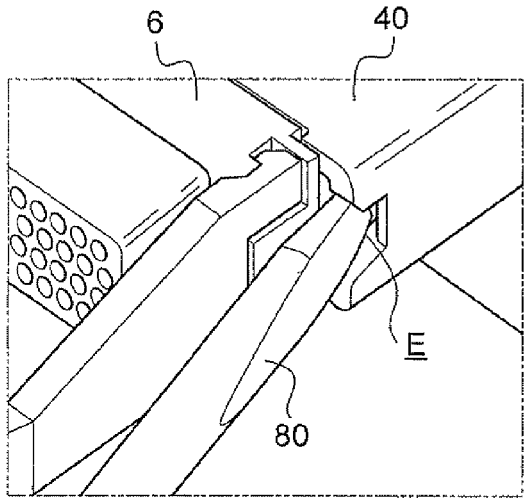

FIGS. 17 and 18 are diagrammatic views of a step of disconnecting the assembly 1. A tool 80 such as a screwdriver may be inserted into the above-mentioned empty space E. Turning the tool 80 while it is arranged in this empty space E causes the locking cap 40 to slide relative to the housings 6 and 50, this sliding bringing the cap 40 into the unlocked position and releasing the connectors 2 and 3.

Figure 20:
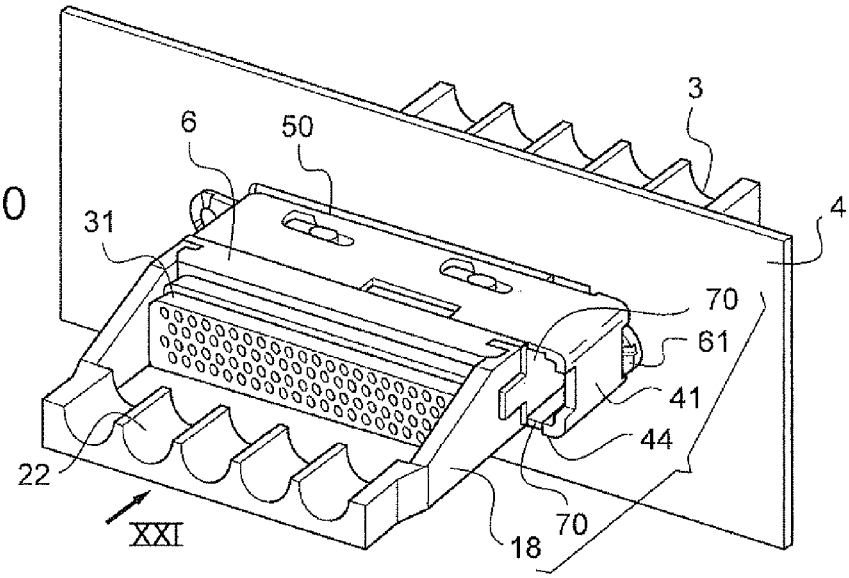
FIGS. 20 to 22 are similar to FIG. 1 showing a connection assembly in another embodiment of the invention, FIG. 21 being a view looking along XXI of the first connector of the assembly shown in FIG. 20.
Figure 21:
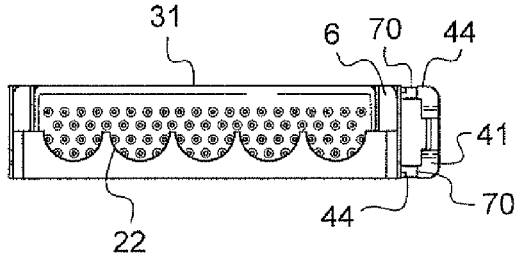
Figure 22:
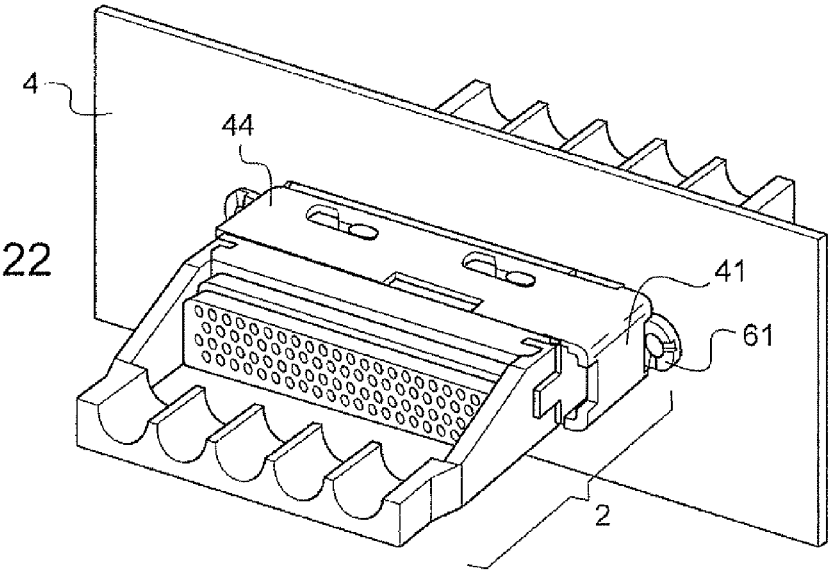

FIGS. 20 to 22 show a connection assembly 1 that differs from that described above solely by the addition of visual indicators 70. As can be seen in FIG. 20, each strip 44 may carry on its edge that is to come into contact with the housing 6 of the first connector 3 a colored mark, e.g. a red mark. This mark is located close to the back 41 so as to be visible when the cap 40 is not in the locked position, as in FIGS. 20 and 21, and to disappear on being masked by the housing 6 when the cap 40 is in the locked position, as in FIG. 22.

The invention is not limited to the embodiments described above.

The term "comprising a" should be understood as meaning "comprising at least one" unless specified to the contrary.

What is claimed is:

1. A multicontact connector comprising:

a housing including cavities;

contacts each having a portion received in one of the cavities and another portion projecting beyond a face of the housing; and a locking cap for locking the connector to a complementary connector, said cap being mounted on the housing and configured to slide relative to the housing between a locked position and an unlocked position;

wherein the cap projects beyond said face of the housing over a distance greater than a distance that the contacts project from said face of the housing, and wherein the housing does not have a rim, at least according to the sliding direction, between the portions of the contacts that are not received in the cavities and the cap.

2. The connector according to claim 1, wherein the housing is made as a single piece.

3. The connector according to claim 1, wherein at least one groove is formed in the cap to co-operate with a locking peg of the complementary connector.

4. The connector according to claim 3, wherein the groove has a long dimension measured between two opposite edges of said groove and defines an amplitude of movement of the cap between the locked position and the unlocked position.

5. The connector according to claim 1, wherein the cap has a width that is greater than a width of the housing.

6. The connector according to claim 5, wherein the cap is substantially U-shaped in section in a plane perpendicular to an axis of the cavities.

7. The connector according to claim 1, further comprising an attachment portion extending the housing from a face of the housing that is opposite from said face.

8. The connector according to claim 1, wherein the cap carries at least one visible indicator arranged to be visible by an operator while the cap is in the unlocked position and to be masked by the housing when the cap is in the locked position.

9. A multicontact connector configured to be connected to the multicontact connector according to claim 1, and comprising a second housing having cavities receiving contacts and at least one locking peg configured to co-operate with the cap, wherein the locking peg is made integrally with the second housing.

10. A connection assembly, comprising:

a multicontact connector according to claim 1; and a complementary multicontact connector configured to be connected to the multicontact connector, and comprising a second housing having cavities receiving contacts and at least one locking peg configured to co-operate with the cap, wherein the locking peg is made integrally with the second housing;

said connectors being locked together by the cap.

11. A connection assembly according to claim 10, wherein the connection assembly is configured to be mounted on a panel.

* * * * *